United States Patent [19]

Grosso et al.

[11] Patent Number: 4,733,233

[45] Date of Patent: Mar. 22, 1988

[54] METHOD AND APPARATUS FOR BOREHOLE FLUID INFLUX DETECTION

[75] Inventors: Donald S. Grosso, West Hartford; G. Robert Feeley, Jr., Middletown, both of Conn.

[73] Assignee: Teleco Oilfield Services Inc., Meriden, Conn.

[21] Appl. No.: 936,185

[22] Filed: Dec. 1, 1986

Related U.S. Application Data

[63] Continuation of Ser. No. 507,146, Jun. 23, 1983, abandoned.

[51] Int. Cl.[4] ..... G01V 1/00; H04H 9/00; B21B 47/00

[52] U.S. Cl. ..... 340/861; 367/82; 367/83; 73/155; 175/48; 324/324

[58] Field of Search ..... 33/302, 306, 307; 73/151, 152, 155; 166/66; 175/40, 45, 48, 50; 181/102, 105, 106, 139, 142, 400, 401; 324/325, 333, 338, 344, 324; 340/611, 619, 626, 661, 853, 861; 364/422, 558; 367/30, 35, 81, 82, 83, 84, 85, 911, 912

[56] References Cited

U.S. PATENT DOCUMENTS

| | | | |
|---|---|---|---|
| 3,789,355 | 1/1974 | Patton | 367/83 X |
| 3,821,726 | 6/1974 | Chan et al. | 175/48 X |
| 3,968,844 | 7/1976 | Walker, Jr. et al. | 175/48 |
| 4,151,457 | 4/1979 | Rau | 324/324 |
| 4,188,624 | 2/1980 | Hochsprung et al. | 340/611 X |
| 4,216,536 | 8/1980 | More | 367/83 |
| 4,253,530 | 3/1981 | Sharhi et al. | 175/48 X |
| 4,297,880 | 11/1981 | Berger | 73/155 |
| 4,299,123 | 11/1981 | Dowdy | 73/155 |
| 4,492,865 | 1/1965 | Murphy et al. | 250/254 X |

FOREIGN PATENT DOCUMENTS 2049934 12/1980 United Kingdom .

OTHER PUBLICATIONS

Oppenheim et al., Digital Signal Processing, Prentice Hall, 1975, pp. 376–395.

*Primary Examiner*—Deborah L. Kyle
*Assistant Examiner*—Brian J. Steinberger
*Attorney, Agent, or Firm*—Fishman & Dionne

[57] ABSTRACT

The infusion of fluid from the formation being drilled into a borehole is detected in an MWD system by modulating the drilling fluid stream in the drill pipe and detecting pressure variations commensurate with the modulation at the surface in the annulus between the drill pipe and wall of the well. Modulation to generate the pressure variations in the annulus is accomplished by the same pressure generating element used to generate pressure signals in the mud column for MWD measurements. The detected pressure variations are compared in phase and/or amplitude with their own near term past history or with the drilling fluid pressure variations in the drill pipe resulting from the modulation. Variations in phase or amplitude which can not be attributed to changes in the drilling operation will be indicative of fluid infusion.

11 Claims, 6 Drawing Figures

SURFACE MEASUREMENTS
TIME
DEPTH
STANDPIPE PRESSURE
MUD TEMP IN/OUT
MUD RES IN/OUT
MUD WEIGHT IN/OUT
ROTARY RPM
WOB
TOB
COMPUTER
ALARM
GAS DETECTION PROGRAM
DOWNHOLE MEASUREMENTS
TEMPERATURE
PRESSURE
RESISTIVITY
GAMMA
WOB
TOB
19
16
42
10
24
18
20
22
40
48
46
38
36
32
34
Ps
PR
66
68
70
60
62
64
12
28
30
26
14

METHOD AND APPARATUS FOR BOREHOLE FLUID INFLUX DETECTION

This application is a continuation of application Ser. No. 507,146, filed June 23, 1983, now abandoned.

BACKGROUND OF THE INVENTION

1. Field of the Invention

The present invention relates to exploration for sources of hydrocarbon fuel and particularly to enhancing the safety of oil and gas well drilling procedures. More specifically, this invention is directed to apparatus and methods for detection of the infusion of gas into a borehole and especially to apparatus and methods for a gas infusion detection system which is continuously operable during drilling for blowout protection.

2. Description of the Prior Art

In the drilling of oil and gas wells, drilling safety and efficiency are paramount considerations. Efficient operation of the drilling apparatus, particularly as wells are drilled deeper and offshore activity increases, demands that data of interest to the driller be collected downhole and be sensed and transferred to the surface "continuously", i.e., without the lengthly delays which would be incident to stopping drilling and lowering test instruments down the borehole. In recent years, significant advances have been made in measurement-while-drilling (MWD) technology. For examples of MWD systems for use in the measurement of borehole directional parameters reference may be had to U.S. Pat. Nos. 3,982,431, 4,013,945 and 4,021,774 all of which are assigned to the assignee of the present invention.

The measurement systems of the above-referenced patents utilize mud pulse telemetry to transmit information from the vicinity of the drill bit to the surface drilling platform. Mud pulse telemetry consists of the transmission of information via a flowing column of drilling fluid, i.e., mud, the information commensurate with the sensed downhole parameters being converted into a binary code of pressure pulses in the drilling fluid within the drill pipe which are sensed at the surface. These pressure pulses are produced by periodically modulating the flowing mud column at a point downhole by mechanical means, and the resulting periodic pressure pulses appearing at the surface end of the mud column are detected by a pressure transducer conveniently located in the standpipe. The drilling mud is pumped downwardly through the drill pipe (string) and thence back to the surface through the annulus between the drill string and wall of the well for the purpose of cooling the bit, removing cuttings produced by the operation of the drill bit from the vicinity of the bit and containing the geopressure.

As noted above, drilling safety is of paramount importance; and one safety problem relates to what is known as a "blowout". A zone of high geopressure, contained by cap rock, will occasionally be unknowingly encountered during drilling. If this pressure exceeds the hydrostatic pressure exerted by the drilling mud, and the formation has sufficient permeability to allow fluid flow, then the formation fluid will displace the drilling mud. This is referred to as a "kick"; and if unchecked will cause what is known as a "blowout" condition. One borehole condition which the driller desires to monitor, in order to ensure against "blowout", is gas influx.

While various techniques have previously been proposed, and in some cases implemented, for measuring gas infusion into a borehole, the previously proposed techniques have not been suited for MWD and have often been either complex, difficult to implement or have been comparatively slow. The prior gas influx measuring techniques have also often been incapable of providing unambiguous information thus requiring repeated tests and/or the use of plural measuring techniques. The methods of measuring gas influx into a borehole proposed in the prior art have included sensing the borehole annulus pressure, sensing the pressure differential between the interior of the drill string and the annulus, measuring the velocity of sound in the drilling mud, measuring the resistivity of the drilling mud and various other tests based upon attempts to measure the pressure of the formation through which the drill string is penetrating or has pentrated. As noted above, these previously proposed gas detection techniques and particularly those based upon pressure measurements, all have deficiencies which precluded their use in MWD and otherwise severly limited their usefulness.

SUMMARY OF THE INVENTION

The present invention overcomes the above briefly discussed and other deficiencies and disadvantages of the prior art by providing a novel technique for sensing and providing an indication of fluid influx into a borehole. The present invention employs mud pulse telemetry and thus is compatible with existing measurement-while-drilling techniques and apparatus.

In application Ser. No. 936,351, being filed contemporaneously herewith, (invented by Donald Grosso, one of the co-inventors hereof, and assigned to the assignee hereof) apparatus and methods are disclosed and claimed for generating reflected pulses in the annulus between the drill string and the borehole and detecting and using those reflected pulses to detect borehole fluid infusion. The present invention evolved from the invention of said other application and involves the generation of the reflected pulses by the signal generator used for regular MWD mud pulse generation.

In accordance with the present invention, the pressure in the annulus between the standpipe (drill pipe or string) and wall of the well is monitored at the surface. Frequency or amplitude modulation of the mud flow in the standpipe by operation of a valve or plunger to generate, e.g., MWD directional signals in accordance with the teachings of the previously references U.S. Pat. Nos. 3,982,431; 4,013,945 and 4,021,774, will result in the mud flow in the annulus containing information in the form of reflections of the MWD signals in the standpipe. Pressure monitoring of the mud flow in the annulus at the surface thus results in the detection of the reflected information resulting from modulation of the column of drilling mud in the drill string (standpipe). In one application of the invention, the pressure variations detected in the annulus are compared to pressure variations detected in the standpipe. A significant change in phase and/or amplitude ratio between the standpipe and annulus pressure variations, particularly a change in phase and/or amplitude ratio which constitutes a significant deviation from a previously established history, will indicate that there is a fluid influx into the annulus since fluid, for example gas, flowing into the drilling mud will produce attenuation of the modulated information and/or will affect the transmission velocity. In accordance with a second application of the invention, the pressure variations in the drilling mud flowing up the annulus are compared with near past history of such annulus pressure variations and, after appropriate compensation for any changes which have been made in the drilling operation, the results of the comparison are used for fluid influx detection. When the annulus signal is lost or severely altered in either amplitude or arrival time or both, an alarm may be instituted indicating that fluid has entered the borehole.

Apparatus for use in the practice of the present invention will include the standard valve or plunger for generating downhole the regular MWD pressure pulse signal, which signals will be propagated both primarily in the drilling fluid in the drill string and secondarily or reflectively in the annulus. The signal generator means will produce pressure pulses, particularly pulses in the sub sonic or sonic frequency range. The apparatus for use with the invention will further comprise means located at the surface for detecting these pressure pulses in the annulus and, in accordance with one embodiment, also in the standpipe. An electrical signal commensurate with the modulation of the drilling fluid, as provided by the surface sensor or sensors, is conditioned to remove noise, i.e, signal variations lying outside of the energy spectrum of the expected signal, and thereafter preferrably converted into digital format for computer processing. In a preferred embodiment the computer will be provided with information commensurate with other drilling parameters which may have an effect on the amplitude and/or phase of the signal or signals detected at the surface. These other drilling parameters may include, by way of example only, drilling fluid temperature which will have an effect on the velocity of sound transmission in the fluid. In one embodiment the conditioned standpipe and annulus pressure signals, after conditioning, are compared and the computer will analyze the results of the comparison to detect changes which cannot be explained by a variation in the drilling parameters. In another embodiment the computer will "look at" only the signal derived from the measurements taken on the drilling fluid flowing in the annulus and will compare such signals with their own stored near past history to look for unexpected variations. In yet another embodiment the sensed pressure signals, either before or in lieu of being converted into digital format, will be adjusted in amplitude and phase so that, under normal operating conditions, the signals commensurate with variations in annulus and standpipe pressure will null one another. Accordingly, only a differences in the conditioned signals greater than a preselected magnitude will be indicative of fluid influx from the formation being drilled into the annulus.

The present invention will be better understood and its numerous objects and advantages will become apparent to and understood by those skilled in the art by reference to the accompanying detailed description and drawings.

BRIEF DESCRIPTION OF THE DRAWING

Referring now to the several FIGURES of the drawings, wherein like reference numerals refer to like elements in the several FIGURES.

DESCRIPTION OF THE PREFERRED EMBODIMENTS

Figure 1:
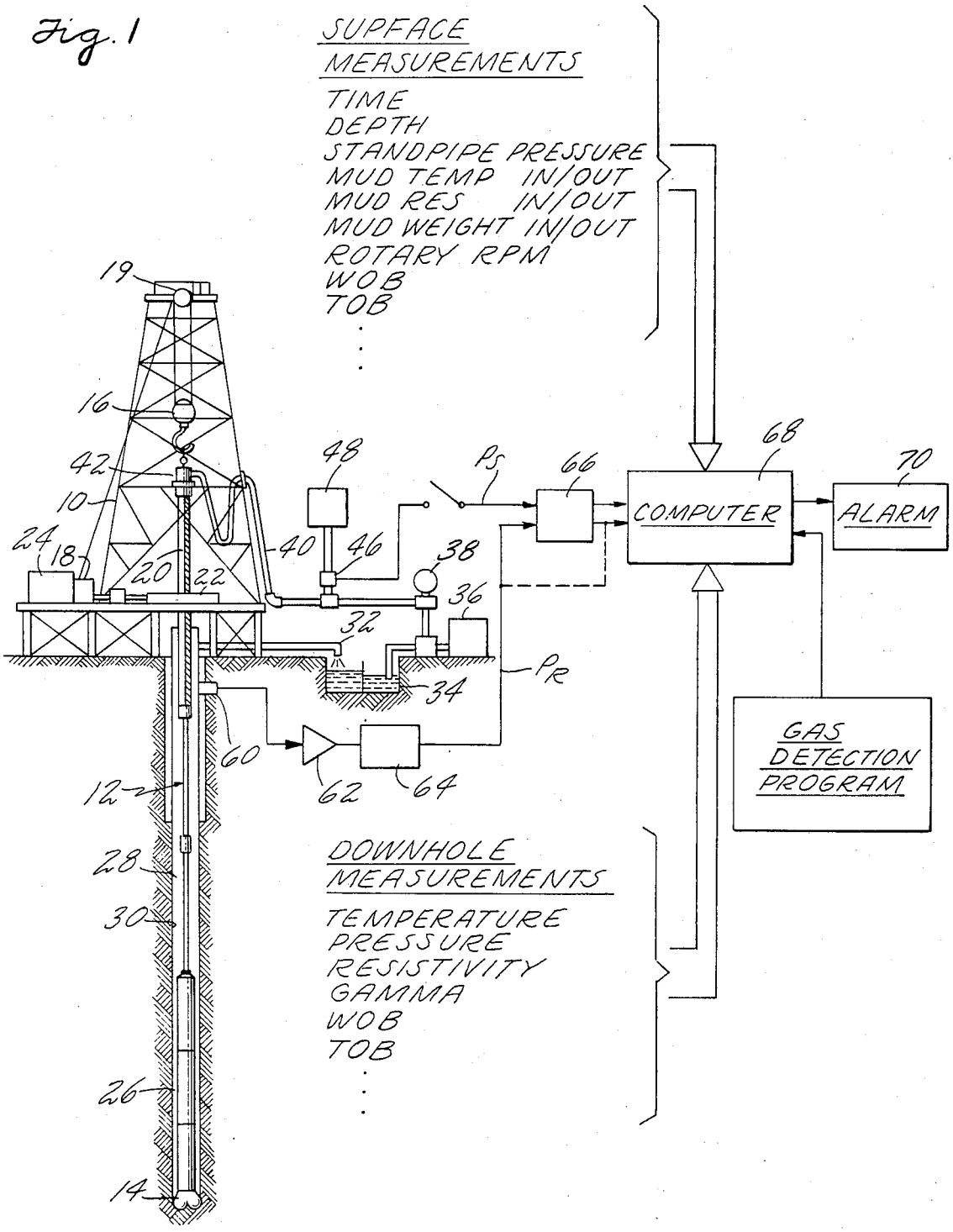
FIG. 1 is a generalized schematic view of borehole drilling apparatus employing the present invention.

Referring to FIG. 1, a drilling apparatus has a derrick 10 which supports a drill string or drill stem, indicated generally at 12, which terminates in a drill bit 14. As is well known in the art, the entire drill string may rotate, or the drill string may be maintained stationary and only the drill bit rotated. The drill string 12 is made up of a series of interconnected pipe segments, with new segments being added as the depth of the well increases. The drill string is suspended from a moveable block 16 of a winch 18 and crown block 19, and the entire drill string of the disclosed apparatus is driven in rotation by a square kelly 20 which slideably passes through and is rotatably driven by the rotatable table 22 at the foot of the derrick. A motor assembly 24 is connected to both operate winch 18 and drive rotary table 22.

The lower part of the drill string may contain one or more segments 26 of larger diameter than the other segments of the drill string. As is well known in the art, these larger diameter segments may contain sensors and electronic circuitry for preprocessing signals provided by the sensors. Drill string segments 26 may also house power sources such as mud driven turbines which drive generators, the generators in turn supplying electrical energy for operating the sensing elements and any data processing circuitry. An example of a system in which a mud turbine, generator and sensor elements are included in a lower drill string segment may be seen from U.S. Pat. No. 3,693,428 to which reference is hereby made.

Drill cuttings produced by the operation of drill bit 14 are carried away by a mud stream rising up through the free annular space 28 between the drill string and the wall 30 of the well. That mud is delivered via a pipe 32 to a filtering and decanting system, schematically shown as tank 34. The filtered mud is then drawn up by a pump 36, provided with a pulsation absorber 38, and is delivered via line 40 under pressure to a revolving injector head 42 and thence to the interior of drill string 12 to be delivered to drill bit 14 and the mud turbine in drill string segment 26.

Figure 2:
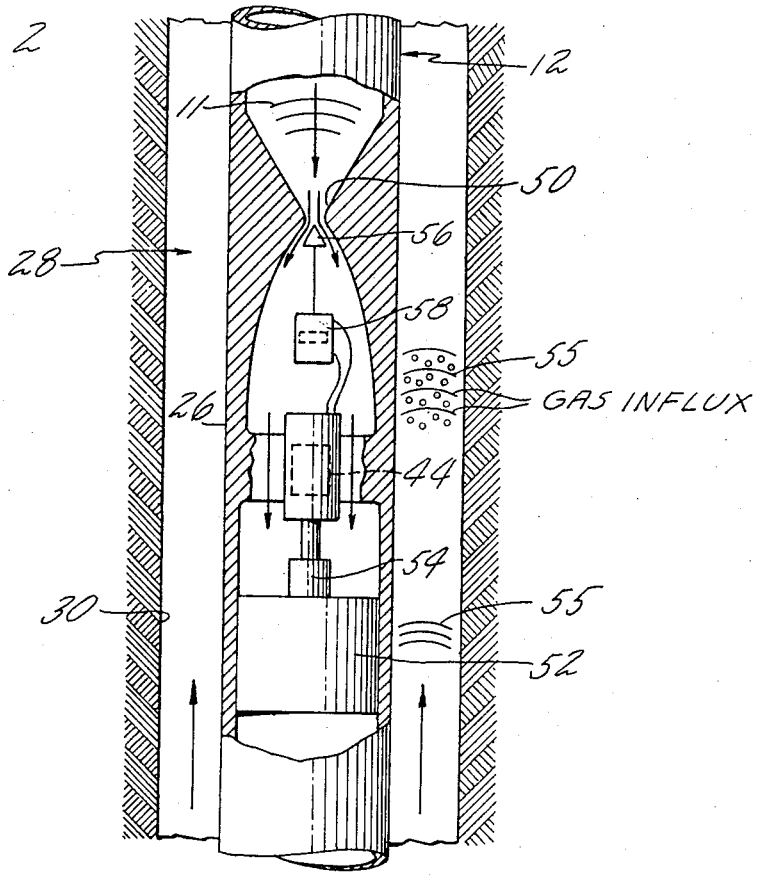
FIG. 2 schematically represents the downhole energy source.

In a MWD system as illustrated in FIG. 2, the mud column in drill string 12 serves as the tranmission medium for carrying signals of downhole drilling parameters to the surface. This signal transmission is accomplished by the well known technique of mud pulse generation whereby pressure pulses (which will be referred to sometimes as "primary pulses") represented schematically at 11, are generated in the mud column in drill string 12 representative of parameters sensed downhole.

The drilling parameters may be sensed in a sensor unit 44 in drill string segment 26, as shown in FIG. 1 which is located adjacent to the drill bit. The pressure pulses 11 established in the mud stream in drill string 12 are received at the surface by a pressure transducer 46 and the resulting electrical signals are subsequently transmitted to a signal receiving and processing device 48 which may record, display and/or perform computations on the signals to provide information of various conditions downhole.

Still referring to FIG. 2, the mud flowing down drill string 12 is caused to pass through a variable flow orifice 50 and is then delivered to drive a turbine 52. The turbine 52 is mechanically coupled to, and thus drives the rotor of, a generator 54 which provides electrical power for operating the sensors in the sensor unit 44. The information bearing output of sensor unit 44, usually in the form of an electrical signal, operates a valve driver 58, which in turn operates a plunger 56 which varies the size of variable orifice 50. Plunger 56 may be electrically or hydraulically operated. Variations in the size of orifice 50 create the pressure pulses 11 in the drilling mud stream and these pressure pulses are sensed at the surface by aforementioned transducer 46 to provide indications of various conditions which are monitored by the condition sensors in unit 44. The direction of drilling mud flow is indicated by arrows on FIG. 2. The pressure pulses 11 travel up the downwardly flowing column of drilling mud within drill string 12.

Sensor unit 44 will typically include means for converting the signals commensurate with the various parameters which are being monitored into binary form, and the thus encoded information is employed to control plunger 56. The sensor 46 at the surface will detect pressure pulses in the drilling mud stream and these pressure pulses will be commensurate with a binary code. In actual practice the binary code will be manifested by a series of information bearing mud pulses of two different durations with pulse amplitude typically being in the range of 30 to 350 psi. The transmission of information to the surface via the modulated drilling mud stream will typically consist of the generation of a preamble followed by the serial transmission of the encoded signals commensurate with each of the borehole parameters being monitored.

As noted above, the drilling mud, after passing downwardly through segment 26 of the drill string, washes the drill bit 14 and then returns to the surface via the annulus 28 between the drill string and the wall 30 of the well. It has been discovered that the pressure pulses resulting from the movements imparted to plunger 56, also travel down the drill string and are reflected from the bottom of the well, although in greatly attenuated form, and result in pulses, indicated schematically at 55 in FIG. 3, in annulus 28 which may be sensed at the surface. Pulse 55 will sometimes be referred to as "secondary" or "reflected" pulses. To this end, as shown in FIG. 1, a second pressure transducer 60 is located at the surface and upstream, in the direction of returning mud flow, from the pipe 32. Typically the magnitude of the pressure pulses detected by transducer 60 are at least an order of magnitude less than the corresponding or companion pressure pulses detected by transducer 46. Nevertheless, through the use of appropriate filtering, these low magnitude pressure pulses in the annulus may be detected.

As noted above, the downhole energy source to generate the pulses 11 and the reflected pulses 55 is, in accordance with the present invention, the mud pulse valve of an existing MWD apparatus as depicted in FIG. 2.

Returning to a discussion of FIG. 1, regardless of the nature of the downhole energy source, the drilling fluid flow will be modulated in the standpipe (i.e , the primary pulses) and the modulation, reflected from the bottom of the well, will also appear as pressure variations (i.e., the relected pulses) in the annulus 28. At the surface the standpipe pressure variations (primary pulses) will be detected by transducer 46 to produce $P_S$ signal. Similarly, the pressure variations (reflected pulses) in the annulus will be detected by transducer 60 and the resulting $P_R$ signal will be conditioned in circuitry which may include an amplifier 62 and filter 64.

The annulus pressure signal $P_R$, and in accordance with some embodiments of the invention also the standpipe pressure signals $P_S$, will be processed in the manner to be described in detail below. This signal processing may include comparing the signals in a comparator 66 followed by computer processing in a computer 68 or may comprise the direct inputting of the $P_R$ signal, and possibly also the $P_S$ signal, to computer 68. In order to enhance the accuracy of the computation in computer 68 one or more drilling parameters measured at the surface and/or one or more drilling parameters measured downhole may also be inputted to the computer 68. The computer 68 will operate in accordance with a gas detection program. The surface measurements which may be inputted to computer 68 include time, distance to the well bottom, standpipe pressure, the temperatures of the drilling fluid at the top of the standpipe and at the top of the annulus, the resistivity of the drilling fluid at the top of the standpipe and at the top of the annulus, the weight and/or density of the drilling fluid in the standpipe and annulus, the rate of rotation of the drill string, the pump strokes of the pump 36, the drilling fluid flow rate and the rate of penetration of the drill. The downhole measured information supplied to computer 68 may include temperature, pressure and resistivity measured in the vicinity of the drill bit. When analysis of the information inputted to computer 68 pursuant to the gas detection program indicates an abnormality, computer 68 will energize an alarm 70.

Figure 3:
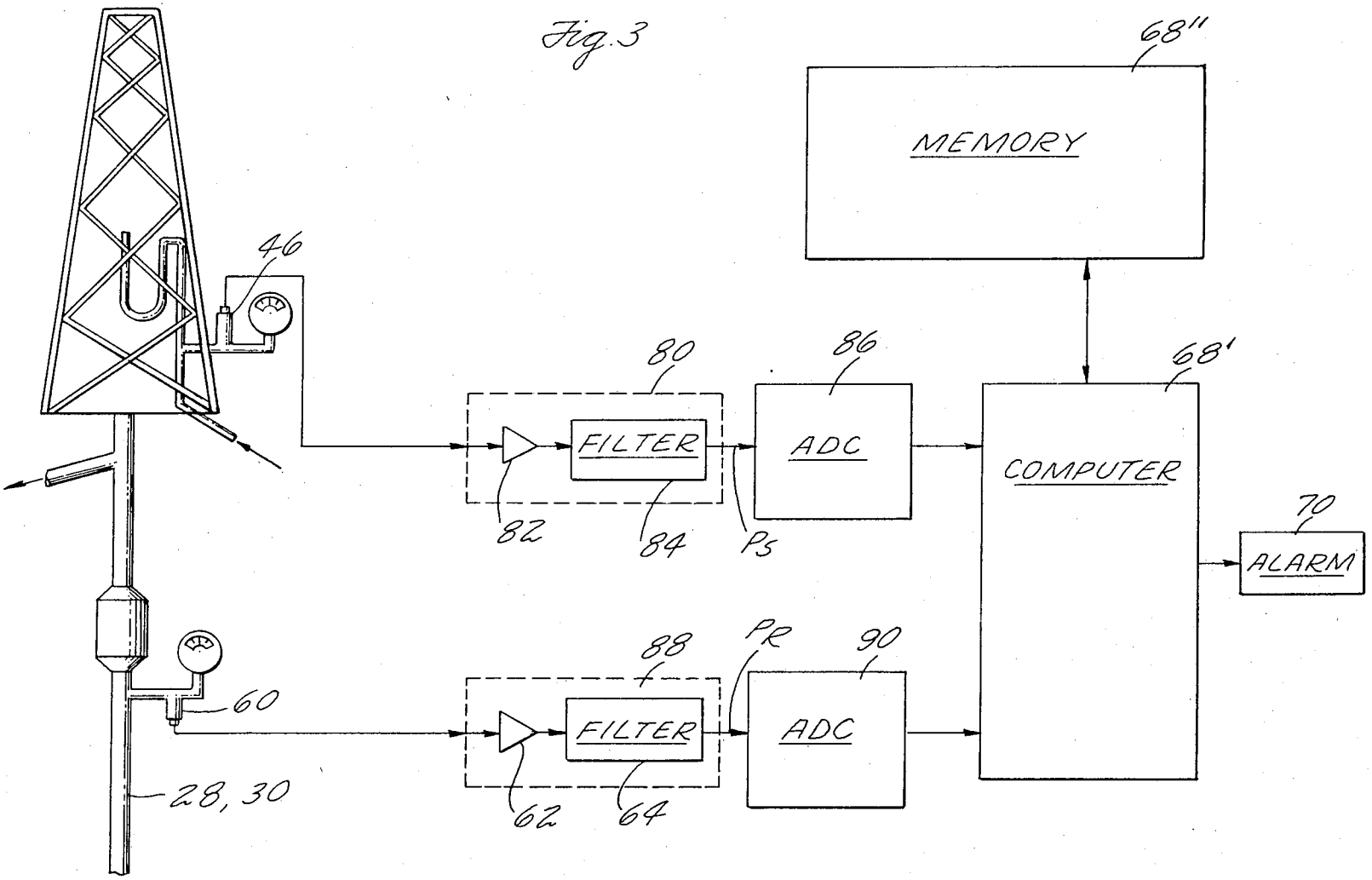
FIG. 3 is a functional block diagram of the surface located components of a borehole gas infusion detection system in accordance with one embodiment of the present invention.

Referring now to FIG. 3, the analog pressure variation signal provided by standpipe pressure sensor 46 is delivered to a signal conditioning circuit 80 comprising amplifier 82 and filter 84. Signal conditioning circuit 80 removes noise outside the energy spectrum of the expected signal to produce a "clean" $P_S$ signal. The $P_S$ signal is converted, in an analog to digital convertor 86, to a digital signal which is subsequently delivered to computer 68'. Similarly, the annulus analog signal provided by transducer 60 is conditioned, in circuit 88, by means of amplifier 62 and filter 64. The resultin $P_R$ signal is converted to digital form, in an analog to digital convertor 90, and then supplied to computer 68'.

Both digital signals are entered into computer 68' at an appropriate rate, for example ten times the Nyquist rate, and the inputted data is stored chronologically in a memory 68'' for further processing. As noted above, drilling parameters such as pump strokes, mud flow rate, rate of penetration, mud temperature, etc. may also be entered into the computer to aid in the determination of gas infusion by factoring out the effects of the drilling operation on the digital signals. Mud temperature, of course, is of interest since the velocity of sound will vary with mud temperature and thus the phase relationships between the $P_S$ and $P_R$ signals will be a function of mud temperature and well depth. It is to be noted that, in addition to the analog signal conditioning circuits 80 and 88, further filtering using conventional digital filtering techniques may be used to reduce unwanted energy from outside sources and to take into account predictable effects such as pump strokes.

The fully conditioned signals are processed in computer 68' under a correlation program. Particularly, the conditioned $P_S$ and $P_R$ signals are compared, the comparison consisting of the correlation between two functions $V_1(t)$ for $P_S$ and $V_2(t)$ for $P_R$ as follows:

$$R_{12}(\tau) = \lim_{T \to \infty} \frac{1}{T} \int_{-\frac{T}{2}}^{+\frac{T}{2}} V_1(t)V_2(t+\tau)dt \quad (1)$$

Where $R_{12}(\tau)$ refers to the correlation between the two signals $V_1$ and $V_2$.

The $P_S$ and $P_R$ signals have a similarity in frequency f(s) because they result from the operation of the same downhole energy source. The $P_S$ and $P_R$ signals also have a characteristic amplitude, respectively A(s) and A(a). The sensed annulus and standpipe pressure signals also have a fixed time relationship, i.e., a delay $\tau$ (d) which is dictated by the signal transmission medium, i.e., the drilling fluid. Through the correlation process, the characteristics of the $P_S$ and $P_R$ signals may be precisely determined on a continuous basis while drilling. When gas or other fluid enters the well bore the determined characteristics are upset by the presence of the intruding fluid. When one or more of the characteristics of the $P_S$ and $P_R$ signals are disturbed in excess of a predetermined limit, the computer 68' will energize the alarm 70.

To elaborate on the above, the velocity of sound in a liquid such as drilling fluid is given by the following equation:

$$C^2 = \frac{K}{\rho} \quad (2)$$

Where:
C is the velocity in cm/s
$\rho$ is the fluid density of gm/cm$^3$
K is the bulk stiffness modulus (reciprocal of adiabatic compressibility) in dynes/cm$^2$.

The absorption of sound in a liquid is given by the following equation:

$$\alpha = \frac{16\pi^2\mu_s}{3\rho C^3} f^2$$

Where:
$\alpha$ is the absorption coefficent (in $1/\sigma$m)
$\mu s$ is the viscosity in poises
$\rho$ is the density in gm/cm$^3$
C is the velocity of sound in cm/s
f is the frequency in Hz As noted above, formation fluid influx into the drilling fluid will affect the velocity of sound and the attenuation of sound in that fluid. For example, the specific gravity of oil, gas and salt water is less than that of a water based drilling mud and, accordingly, the density of a mixture of drilling mud and one of these other fluids will be lower than the density of the "pure" drilling mud.

Normally the pressure related signals $P_S$ and $P_R$ respectively provided by the standpipe transducer 46 and the annulus transducer 60, will be different in amplitude and phase because of a slight difference in transfer functions. These differences will be stored in memory 68'. When formation fluid flows into the annulus the transfer function, and thus the annulus pressure signal $P_R$ will change. The transfer function for the standpipe fluid, and accordingly the signal $P_S$ will remain unchanged. For example, assume that there is gas infusion from the formation into the annulus. The mixing of the gas influx with the drilling fluid will result in the density of the fluid in the annulus decreasing whereupon the amplitude of the $P_R$ signal provided by transducer 60 will decrease. The fact that the $P_S$ signal provided by transducer 46 has not changed in proportion to the change in $P_R$ signal is evidence that there has been a fluid influx into the bore hole. There will also be a change in the phase angle relationship of $P_S$ to $P_R$ which results from the fact that the speed of sound in the fluid will change with the inverse of the square root of density. A change in phase difference or relative amplitude in excess of predetermined limits will result in computer 68' generating signal which energizes the alarm 70.

Figure 4:
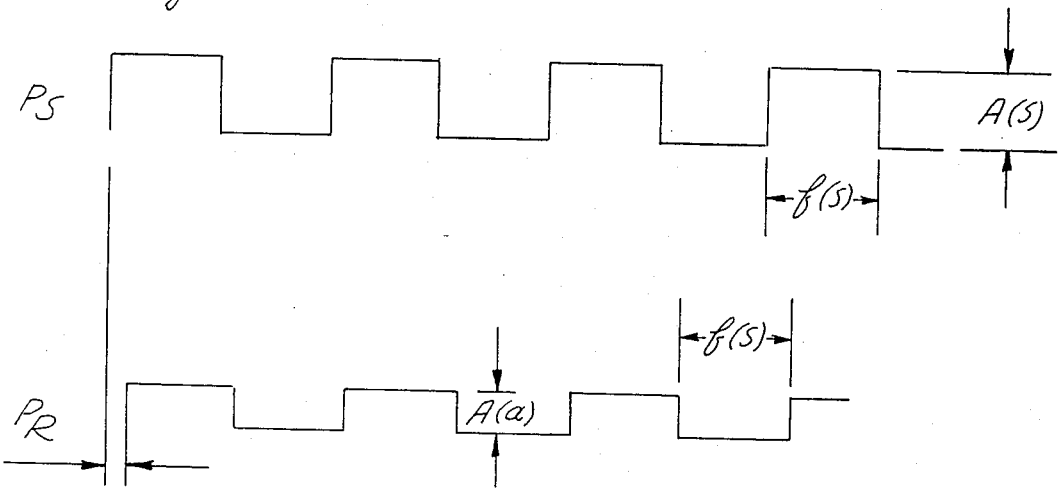
FIG. 4 is a waveform diagram depicting pressure signals sensed in accordance with the practice of the embodiment of FIG. 3 after the preconditioning thereof.

FIG. 4 is a representation of signals which would ideally be provided at the output of the signal conditioning circuits 80 and 88 as a result of the downhole modulation of the drilling fluid at a frequency f(s). In actual practice the difference in amplitude of the standpipe and annulus signals is considerably greater than shown on FIG. 4 and this difference in characteristic amplitude is reduced through the use of the amplifiers in the signal conditioning circuits 80 and 88.

Figure 5:
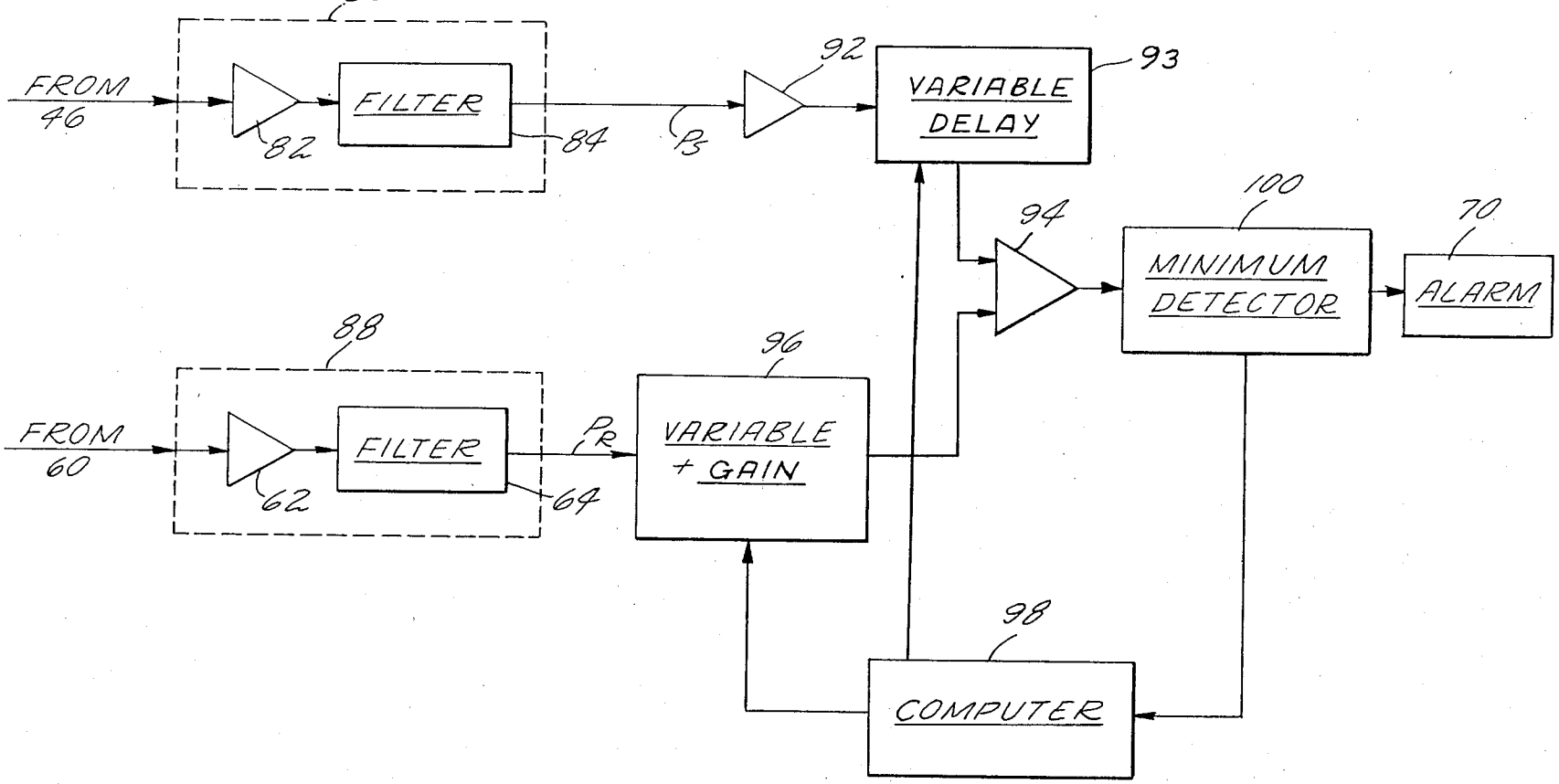
FIG. 5 is a functional block diagram of the surface located components of a borehole gas infusion detection system in accordance another embodiment of the present invention.

FIG. 5 may be considered to be a simplified hardware version of the embodiment of FIG. 3. In the FIG. 5 embodiment, the output signals from the signal conditioning circuits 80 and 88 are not converted to digital form. Rather the $P_S$ signal from conditioning circuit 80 is inverted in inverting amplifier 92 and then delivered to a variable circuit 93 to delay the $P_S$ signal so that it arrives at a summing amplifier 94 coincidently with the $P_R$ signal. The output from delay 93 is applied as a first input to a summing amplifier 94. The $P_R$ signal from conditioning circuit 88 is applied to a variable gain circuit 96. The gain of $P_R$ is adjusted in circuit 96 such that the output of circuit 96, which functions as the second input to summing amplifier 94 will null the signal from inverter 92 and delay 93 when the correct amplitude and delay have been selected. Control of the gain of the $P_R$ and delay of the $P_S$ signals is under the control of a computer 98 connected to delay circuit 93 and gain circuit 96, the selected gain and delay being commensurate with the characteristic information of the system. The output from summing amplifier 94 is delivered to a detector 100, and detector 100 will provide a dc output voltage level commensurate with the average error signal appearing in the output of summing amplifier 94. Should either or both of the phase difference or amplitude ratio between the pressure signals in the standpipe and annulus vary by greater than a preselected minimum, the variation being detected by a detector circuit 100, the alarm 70 will be energized.

It is to be noted that the embodiment of FIG. 3, rather than applying a correlation program in computer 68, may operate with a summation and minimum detection program and thus be the digital equivalent of the FIG. 5 embodiment.

Figure 6:
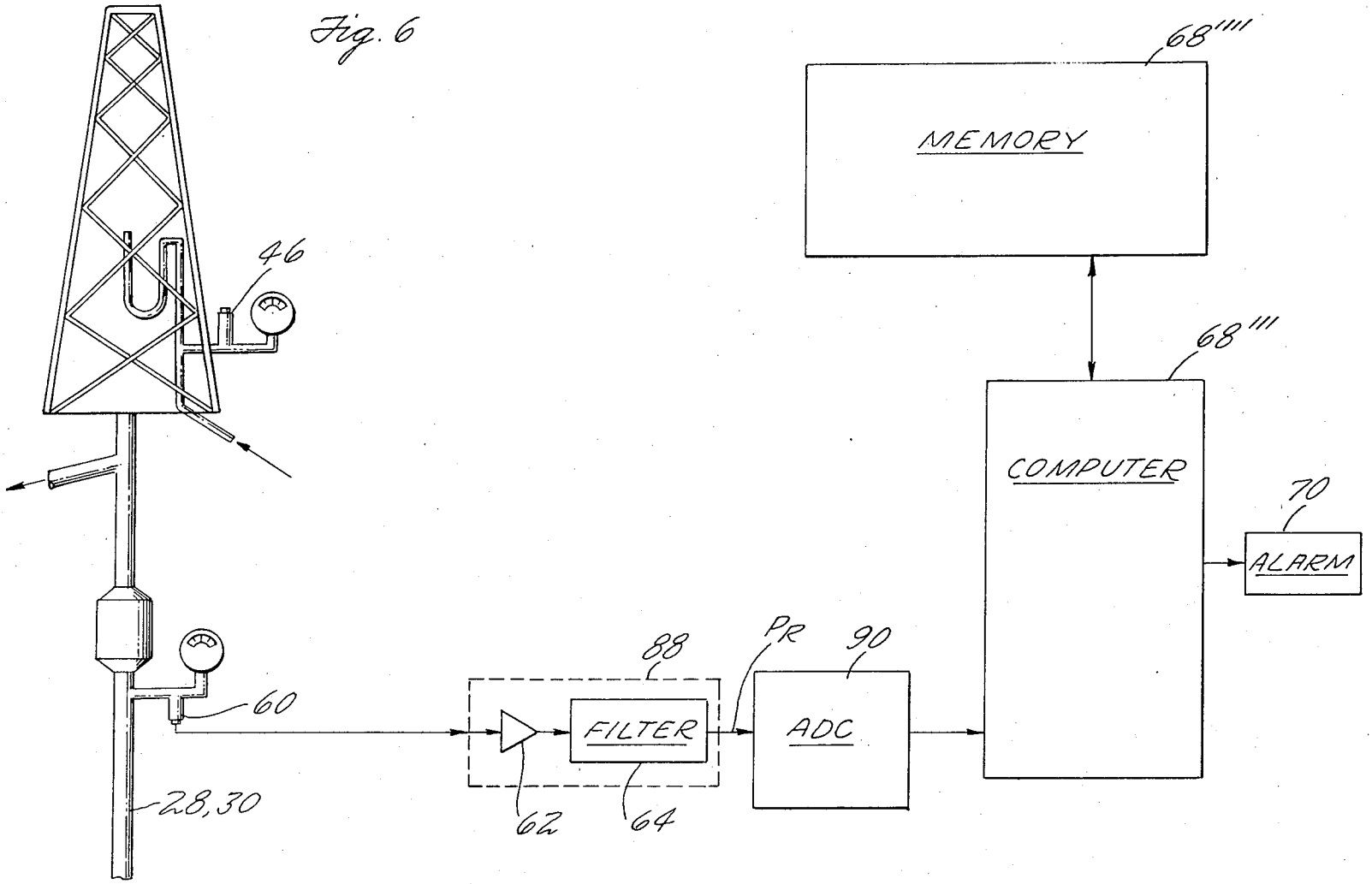
FIG. 6 is a functional block diagram of the surface located components of a borehole gas infusion detection system in accordance with yet another embodiment of the present invention.

FIG. 6 comprises an embodiment of the present invention where only the annulus pressure $P_R$ is employed with comparison being made between the instantaneous characteristics of $P_R$ and the near term history (e.g., past ½ hour) thereof. The signal $P_R$ will be delivered to a conditioning circuit 88 and the output of the signal conditioning circuit will be converted into a digital signal by ADC 90. The digital signal is delivered as an input to computer 68''' which operates under the control of an auto-correlation program stored in memory 68''''. In the FIG. 6 embodiment, when the characteristics of the $P_R$ signal vary in a manner that cannot be explained by changes in drilling parameters such as mud flow rate or mud temperature, the alarm 70 will be energized. Thus, by way of example, if the amplitude of the $P_R$ signal decreases in a manner which cannot be explained by the drilling conditions, attenuation caused by fluid influx from the formation into the bore hole will be the likely cause. Similary, if there is an unexplained phase shift in the $P_R$ signal compared to its own near term history, the cause will also likely be formation fluid influx into the bore hole.

In the context of MWD and the present invention, phase shift detection offers a special opportunity to monitor for gas infusion. A phase shift between $P_S$ and $P_R$ occurs when fluid enters annulus 28 because the transmission time for $P_R$ changes because of change in density of the mud in the annulus. This phase shift occurs regardless of whether the signal $P_R$ is of constant or variable frequency. However, there is also a special phase shift that occurs if there is a frequency change in the generated signal. Thus, when going from a digital 1 to 0 or from 0 to 1 in $P_S$, there will be a phase shift present in $P_S$ in drill string 12 and in $P_R$ in annulus 28. A recongizable relationship exists between these special phase shifts in the absence of fluid influx into annulus 28. If fluid influx occurs, this relationship between these phase shifts will change, to indicate fluid influx. Thus, this phase relationship and departure therefrom is an additional signal characteristic usable in the present invention for signal comparison as described above.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for detection of fluid influx in a borehole in which a drill string is positioned, the drill string cooperating with the wall of the borehole to define an annulus, and in which drilling fluid is circulated from the surface through the interior of the drill string and into the annulus back to the surface, and in which data bearing primary signals are transmitted to the surface in the drilling fluid by operation of pressure generating means in said drill string, and in which reflected signals of said primary signals are transmitted to the surface in the annulus through the drilling fluid, the apparatus for detection of fluid influx including:

means for detecting in said annulus the reflected signals of the primary signals in the drilling fluid in said drill string, said reflected signals defining secondary signals;

means for detecting said primary signals;

means for measuring the difference between at least one selected parameter of said primary signals with the same selected parameter of said secondary signals wherein the entire drill pipe is a reference with which to make a differential comparison to the entire annular space; and means for determining changes in said measured difference between the selected parameter of said primary and secondary signals wherein fluid influx into the annulus is determined.

2. The apparatus of claim 1 wherein said means for detecting said primary signals comprises:

means for sensing pressure pulses.

3. The apparatus of claim 1 wherein:

said selected parameter is amplitude.

4. The apparatus of claim 3 wherein:

said means for detecting said primary signal includes first transducer means for receiving said primary signal and generating a first output signal commensurate therewith;

said means for detcting said secondary signal includes second transducer means for receiving said secondary signal and generating a second output signal commensurate therewith.

5. The apparatus of claim 1 wherein said selected parameter is the phase of said signal.

6. The apparatus of claim 5 wherein:

said means for detecting said primary signal includes first transducer means for receiving said primary signal and generating a first output signal commensurate therewith;

said means for detecting said secondary signal includes second transducer means for receiving said secondary signal and generating a second output signal commensurate therewith.

7. The apparatus of claim 1 wherein said means for detecting said secondary signals comprises:

means for sensing pressure pulses.

8. The apparatus of claim 7 wherein said means for detecting said secondary signals comprises:

means for sensing pressure pulses.

9. A method of monitoring a well drilling operation for the presence of fluid influx into the bore hole, the drill operation comprising the use of a tubular drill pipe having a diameter which is less than the diameter of the borehole being formed wherein a generally annular space is defined between the drill pipe and the borehole, said monitoring being performed during the drilling of the borehole, and in which drilling fluid is pumped down the interior of the drill pipe, the drilling fluid existing at about the base of the drill pipe and returning to the surface via the generally annular space between the drill pipe and borehole wall, and in which data bearing primary signals in the form of primary pressure pulses are transmitted to the surface in the drilling fluid by the operation of pressure generating means in the drill string, the method comprising the steps of:

sensing in said annular space reflected pressure pulses of the primary pulses in the drilling fluid in the drill pipe, said reflected pressure pulses defining secondary pressure pulses;

measuring the difference between one selected parameter of the pressure pulses in the interior of the drill pipe with the same selected parameter of the pressure pulses in the annular space wherein the entire drill string is a reference with which to make a differential comparison to the entire annulus; and determining changes in said measured difference between the selected parameters of said primary and secondary pulses wherein fluid influx into the annulus is determined.

10. The method of claim 9, wherein:

the parameter is amplitude.

11. The method of claim 9 wherein:

the parameter is phase.

* * * * *